US010016082B1

(12) United States Patent
Merker

(10) Patent No.: US 10,016,082 B1
(45) Date of Patent: Jul. 10, 2018

(54) GARMENT REMOVAL APPARATUS AND METHOD

(71) Applicant: Stephen L. Merker, Louisville, KY (US)

(72) Inventor: Stephen L. Merker, Louisville, KY (US)

( * ) Notice: Subject to any disclaimer, the term of this patent is extended or adjusted under 35 U.S.C. 154(b) by 0 days.

(21) Appl. No.: 15/673,900

(22) Filed: Aug. 10, 2017

(51) Int. Cl.
*A47G 25/80* (2006.01)
*A47G 25/90* (2006.01)

(52) U.S. Cl.
CPC ..... *A47G 25/90* (2013.01)

(58) Field of Classification Search
CPC ..... A47G 25/90
USPC ..... 223/111; 294/3.6, 8.5, 219
See application file for complete search history.

(56) References Cited

U.S. PATENT DOCUMENTS

| | | | | |
|---|---|---|---|---|
| 1,810,363 | A | 6/1931 | Malapeta | |
| 3,568,901 | A * | 3/1971 | McNitt | A47G 25/902 223/111 |
| 4,892,239 | A * | 1/1990 | Tomasi | A47G 25/90 223/111 |
| 5,069,374 | A * | 12/1991 | Williamson | A47G 25/908 223/111 |
| 5,501,376 | A * | 3/1996 | Roda-Balzarini | A47G 25/90 223/111 |
| 7,270,253 | B2 * | 9/2007 | Radke | A47G 25/908 223/112 |
| 8,910,983 | B1 | 12/2014 | Neff | |
| 9,498,076 | B1 | 11/2016 | Reid | |
| 9,615,685 | B2 | 4/2017 | Fischer | |
| 2005/0205619 | A1 * | 9/2005 | Morel | A47G 25/90 223/111 |
| 2008/0217365 | A1 | 9/2008 | Fox | |
| 2009/0039118 | A1 * | 2/2009 | Whitlaw | A47G 25/90 223/111 |
| 2010/0078450 | A1 * | 4/2010 | Longhurst | A47G 25/90 223/111 |
| 2010/0258600 | A1 * | 10/2010 | Pfistor | A47G 25/90 223/111 |
| 2011/0315724 | A1 * | 12/2011 | Whitlaw | A47G 25/90 223/111 |
| 2012/0223109 | A1 | 9/2012 | Wheeler, Sr. | |
| 2013/0270310 | A1 * | 10/2013 | Santos | A47G 25/90 223/111 |
| 2016/0022078 | A1 * | 1/2016 | Sclafani | A41F 11/16 2/315 |
| 2016/0213184 | A1 | 7/2016 | Kobyluck | |
| 2017/0035231 | A1 | 2/2017 | Miels | |

FOREIGN PATENT DOCUMENTS

| | | |
|---|---|---|
| DE | 19849137 | 4/1999 |
| GB | 232141 | 4/1925 |
| SE | 201550201 | 8/2016 |

* cited by examiner

*Primary Examiner* — Nathan Durham
(74) *Attorney, Agent, or Firm* — Middleton Reutlinger

(57) ABSTRACT

A garment removal apparatus and method of using the apparatus to remove a garment from the upper body. The garment removal apparatus may include one or more cables and one or more clips attached depending from an attachment mechanism. With one or more clips secured to the upper body garment, the user moves away from attachment mechanism and may progressively remove the garment from the user.

18 Claims, 4 Drawing Sheets

GARMENT REMOVAL APPARATUS AND METHOD

BACKGROUND

The present embodiments relate to a garment removal apparatus and method, with particular embodiments shown for a removal apparatus and method for removing a garment from the upper body.

Typical garment removal devices may require the user to manipulate a device with one or more hands to remove the article of clothing that may be difficult for a user with limited arm and/or shoulder mobility. Limited mobility of an arm, hand, and/or shoulder may include, but is not limited to, recent shoulder surgery. Thus, there is a need for an apparatus and method for removing a variety of upper body garments because of reduced body, limb, hand, and/or shoulder mobility and/or other medical or health conditions.

SUMMARY

In some embodiments of the invention, for example, may include a method of removing a garment from the upper body comprising the step of providing an attachment mechanism. In various embodiments, the method may include attaching the attachment mechanism to an object. In some embodiments, the method may include providing at least one elongated cable having opposing free ends, wherein at least one cable may be coupled between the opposing free ends to the attachment mechanism. In various embodiments, the method may include providing a clip at each opposing free end of at least one cable. In some embodiments, the method may include attaching each clip adjacent to the garment waist, wherein the clips are spaced apart from each other. In various embodiments, the method may include increasing a distance of the user from the object. In some embodiments, the method may include progressively pulling the garment away from the user in a direction from the waist towards the shoulders.

In various embodiments, the method may include the attachment mechanism may be at an elevation above at least one of the waist, the chest, and the shoulders of the user. Moreover, in some embodiments, the attachment mechanism may be at the elevation above the shoulders. In some embodiments, the method may include adjusting an elevation of the attachment mechanism relative to the user. In various embodiments, the step of increasing the distance of the user from the object may include the user facing towards the object. In some embodiments, the step of increasing the distance of the user from the object may include raising and extending both arms. In various embodiments, the method may include removing the clips from the garment after the step of progressively pulling the garment away from the user in the direction from the waist towards the shoulders. In some embodiments, the step of increasing the distance of the user from the object may include progressively increasing an angle of at least one cable from a substantially vertical plane. In addition, in some embodiments, the step of progressively pulling the garment away from the user in the direction from the waist towards the shoulders may include sliding the garment over the chest, the shoulders, and the arms. In some embodiments, the step of increasing the distance of the user from the object may include horizontally moving away from the object. In some embodiments, the method may include adjusting a length of at least one cable from the attachment mechanism to at least one clip.

In some embodiments, a method of removing a garment from the upper body may comprise the step of providing a first clip and a second clip attached to opposing free ends of at least one cable, wherein an attachment mechanism in a vertical plane may be secured between the opposing free ends of at least one cable. In various embodiments, the method may include attaching the first clip and the second clip to the garment adjacent the waist. In some embodiments, the method may include moving the upper body of the user away from the attachment mechanism. In addition, in various embodiments, the method may include progressively sliding the garment in sequence from the waist towards the shoulders.

In various embodiments, the step of moving the upper body of the user away from the attachment mechanism may include moving a distance transverse to the vertical plane of the attachment mechanism. In some embodiments, the step of moving the upper body of the user away from the attachment mechanism may include the user facing towards the object. In various embodiments, the step of moving the distance transverse to the vertical plane of the attachment mechanism may include progressively increasing an angle of at least one cable from the vertical plane. In some embodiments, the method may include adjusting a length of at least one cable from the attachment mechanism to at least one of the first clip and the second clip. In various embodiments, the method may include adjusting an elevation of the attachment mechanism relative to the user. In some embodiments, the method may include removing the first clip and the second clip from the garment after the step of progressively sliding the garment in sequence from the waist towards the shoulders.

In addition, in various embodiments, an apparatus for removing a garment from the upper body may comprise an attachment mechanism. In some embodiments, the apparatus may include at least one elongated cable having opposing free ends, wherein at least one cable may be coupled between the opposing free ends to the attachment mechanism. In various embodiments, the apparatus may include a first clip attached to one opposing free end of at least one cable and a second clip attached to the other opposing free end of at least one cable. In some embodiments, the apparatus may include each first clip and second clip may be capable of releasably securing adjacent to the garment waist, wherein the garment does not pull from the first clip and the second clip until released by the user.

In various embodiments, at least one cable, the first clip, and the second clip may pivot relative to the attachment mechanism. In some embodiments, each portion of at least one cable extending from the attachment mechanism to the first clip and the second clip, respectively, may change angles relative to each other portion of at least one cable. In addition, in some embodiments, a length of the portion of at least one cable between the attachment mechanism and the first clip may be adjusted between a first length and a second length, wherein the first length may be longer than the second length. In various embodiments, the apparatus may be in combination with a kit comprising an arm sling.

These and other advantages and features, which characterize the embodiments, are set forth in the claims annexed hereto and form a further part hereof. However, for a better understanding of the embodiments, and of the advantages and objectives attained through its use, reference should be made to the drawings and to the accompanying descriptive matter, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques for a garment removal apparatus 20, such as the type that may be used by an individual for post-surgery applications such as, but is not limited to, recovering from shoulder and/or arm surgery or in other health or medical conditions limiting mobility that makes removal of an upper body garment difficult. However, it will be appreciated that the herein-described apparatus and techniques may also be used in connection with other types of post-surgery and/or non-residential user applications in some embodiments. For example, the herein-described apparatus and techniques may be used in hospitals, assisted living, and/or nursing homes applications in some embodiments. Moreover, the herein-described apparatus and techniques may be used in connection with a variety of garment removal apparatus configurations.

Figure 1:
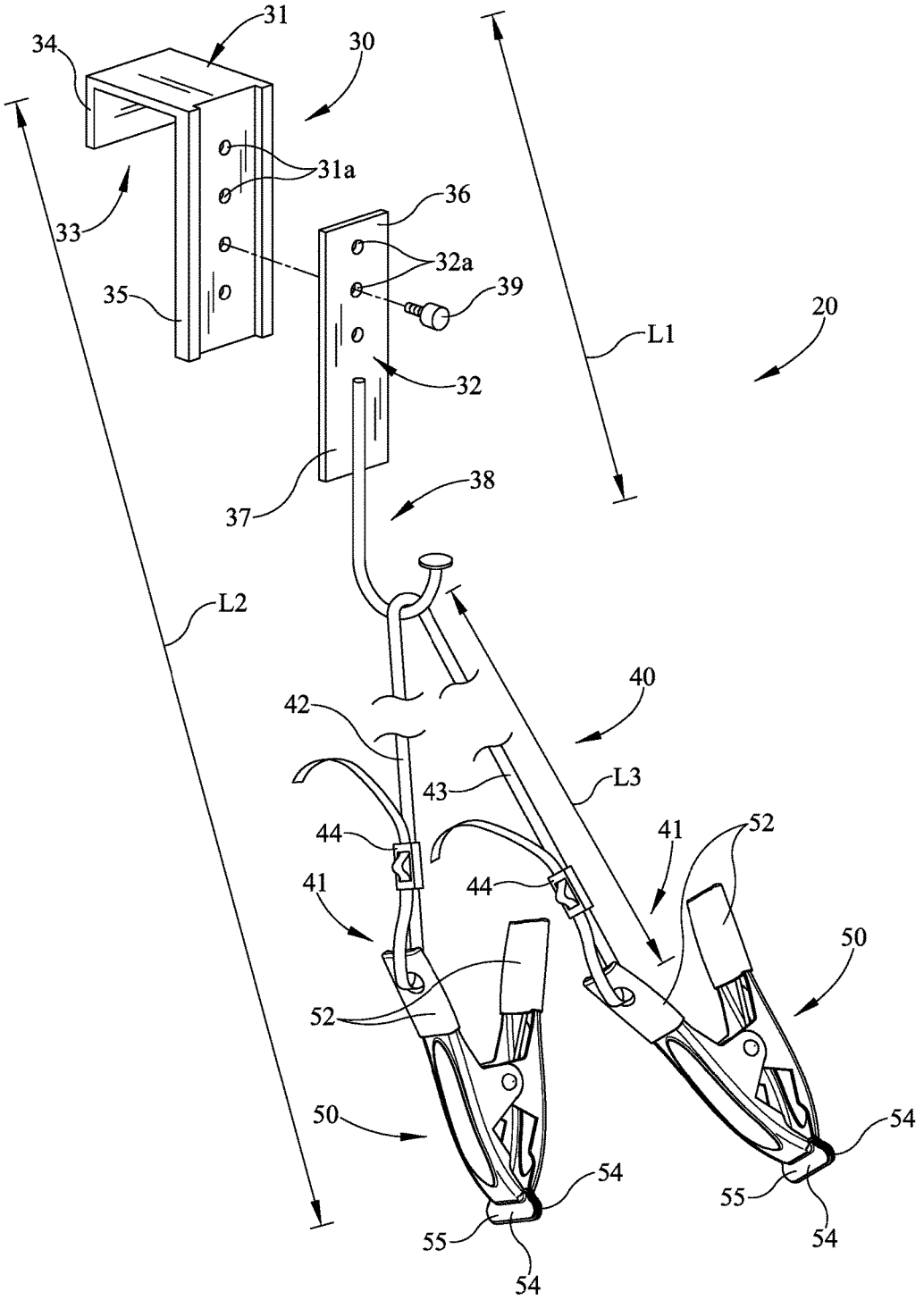
FIG. 1 is a perspective view of one embodiment of a garment removal apparatus with portions of the attachment mechanism exploded away from each other.

Turning now to the drawings, wherein like numbers denote like parts throughout the several views, FIG. 1 illustrates an example garment removal apparatus 20 in which the various technologies and techniques described herein may be implemented. An embodiment of the apparatus 20 may include one or more attachment mechanisms 30, one or more cables 40, and one or more clips 50. In a preferred embodiment, the attachment mechanism 30 secures to an object 1 (e.g. door) with one or more cables 40 and corresponding clips 50 depending therefrom to aid the user when it is desired to remove the garment 3 from the upper body of the user 2. In applications, the apparatus 20 may be permanently affixed to the object 1 and/or releasably removable therefrom. If removed, the apparatus 20 may be subsequently reattached to the same location/object or another location or object. For example, a user 2 may only need the apparatus 20 for a temporary timeframe, such as post-surgery. Other users, may need the apparatus to be transportable to accommodate travel between applications such as multiple residences, gyms, hotels or be attached to other objects within different applications where the user may need to remove the upper body garment. In some embodiments, the apparatus 20 or portions thereof may be adjustable in length, construction, or other characteristics to accommodate different users (e.g. users of different heights, waist circumference, upper and/or lower mobility, etc), different garments, and/or different applications or objects (e.g. one or more types of doors, furniture, vehicle, one or more types of walls, windows, etc.) that are available to be attached thereto.

The garment removal apparatus 20 may include the attachment mechanism 30 capable to be secured to a one or more objects 1 of varying characteristics (e.g. size, shape, one or more surfaces, etc) and couple to the cables 40 and/or clips 50. In the embodiment shown, the attachment mechanism 30 may be secured to an object 1 such as the top of a door, window, locker, etc. Although the attachment mechanism 30 may be a single piece in some embodiments, it is shown to be constructed of more than one piece. The attachment mechanism 30 may include a first portion 31 and a second portion 32 in various embodiments. The first portion 31 may include a first hook 33 at a first end 34 that may be secured to the top of the object 1 or door as is shown. A second end 35 of the first portion 31 may overlap or be adjacent the second portion 32. The second portion 32 may have a first end 36 adjacent the first portion 31 and the opposing second end 37 distal from the first portion 31 may include another or second hook 38. The second hook 38 may be reversed and/or inverted as compared to the first hook 33. The body of each of the first portion 31 and second portion 32 may include a plurality of apertures 31*a*, 32*a*, respectively. A fastener 39 may combine the apertures 31*a*, 32*a* of the first portion 31 and the second portion 32. By selecting apertures corresponding to the overlapping portions 31, 32, the user may adjust the distance to the one of more cables 40 or length L1 of the attachment mechanism and/or the overall length L2 of the apparatus 20. The attachment mechanism 30 may couple to the one or more depending elongated cables 40, or more specifically in some embodiments the second hook 38 couples to a portion between the opposing free ends 41 of the one or more cables 40. In some embodiments, the one or more cables may attach to one of a plurality of locations (e.g. a plurality of vertically spaced hooks) to create a variety of lengths L1 between the object and the desired cable attachment position/location.

In various embodiments, the attachment mechanism 30, or portions thereof, may in some embodiments may be capable of attaching to a variety of objects 1. The apparatus 20 may attach to the wall and/or to the door in various embodiments. For example, the second portion 32 may be used by itself. The second portion 32 may be secured by the fastener 39 (e.g. nail or screw) to a face of a wall or surface. In some embodiments, the attachment mechanism may be secured to glass such as to the face of a sliding glass door or window by one or more suction cups. Other examples, may include magnets and/or adhesive to secure the attachment mechanism to the object. The attachment mechanism 30 may be a variety of quantities, shapes, sizes, constructions, and orientations and still be within the scope of the teachings herein.

The attachment mechanism 30 may be attached to the object at a variety of elevations or heights. In a preferred embodiment, the attachment mechanism may be positioned above the waist and/or chest of the user. More specifically, the elevation may be above the shoulders and/or head in various embodiments. In some embodiments, the higher the elevation of the attachment mechanism relative to the attached cables/clips and/or the less overall length of the apparatus, the less the user may have to lean towards the attachment mechanism, if needed, to assist removal while increasing the distance D from the attachment mechanism.

As illustrated in the Figures, one or more cables 40 may depend from the attachment mechanism 30 to the respective one or more clips 50. In a preferred embodiment, the one or more cables 40 may be made of flexible nylon material. However, a variety of suitable materials may be used. In some embodiments, the cable or cord may be steel, rope, braided cables, etc. The cables 40 may be substantially non-stretchable in various embodiments. As is shown the opposing free ends 41 of at least one cable 40 are attached to each respective clip 50. A first portion and/or first cable 42 extends from the attachment mechanism 30 to the clip 50. A second portion and/or second cable 43 extends from the attachment mechanism 30 to the other clip 50. The cable or portions thereof 40 may be adjustable in length L3. The cable or portions thereof 40 may be adjustable in length to adjust the distance or length L3 between the attachment mechanism 30 and the respective clip 50. As shown in the embodiment, the cable 40 may be a strap with one or more buckles 44 that may allow for the cable to be adjusted (e.g. increase or decrease) in length between a first length and second length. However, it should be understood that the first cable 42 and/or second cable 43 may be fixed in length in various embodiments. Although the cable is shown as a single piece between the clips 50, the cable 40 may be separate cables secured to the one or more attachment mechanisms. Moreover, although the one or more cables as shown are not fixed to the attachment mechanism 30 or second hook 38, it should be understood that the one or more cables or portions between the opposing free ends 41 may be fixed to the attachment mechanism. In some embodiments, the cable may extend from attachment mechanism and then split or diverge into two or more cables extending to the respective clips. The cable 40 may be a variety of quantities, shapes, sizes, constructions, and orientations and still be within the scope of the teachings herein.

Figure 2:
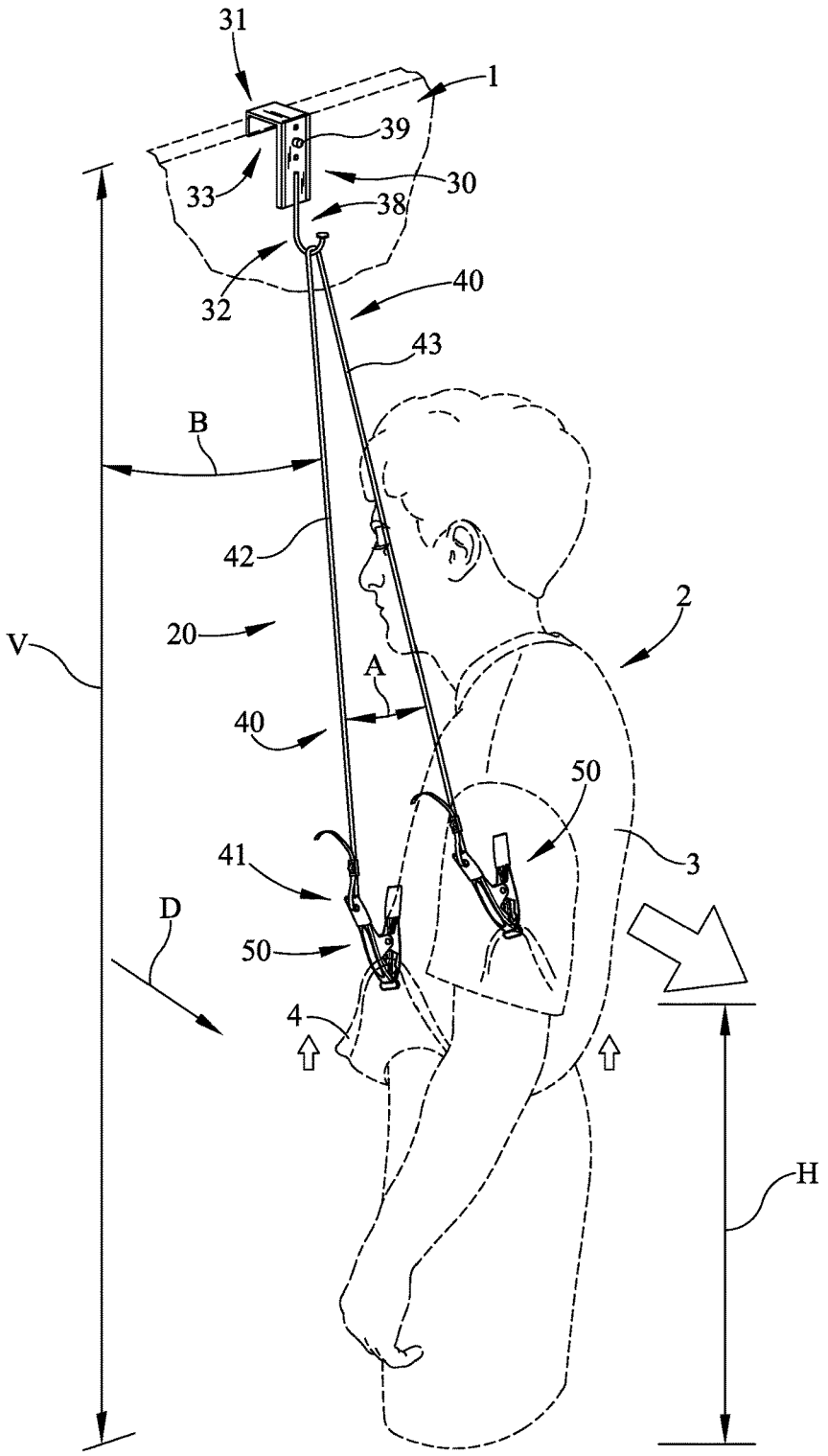
FIG. 2 is a perspective view of the apparatus of FIG. 1 illustrating the attachment mechanism mounted to an elevated object at one end and at the other end the clips secured to the upper body garment adjacent the waist of the user.

As illustrated, one or more clips 50 may be used to secure the cables 40 of the apparatus 20 to the upper body garment 3. In some embodiments, each clip 50 extends from the respective opposing free ends 41 of the cable 40. Each clip 50 supplies sufficient force to secure to the garment 3 without releasing therefrom while the user 2 is moving away from the attachment mechanism 30 or apparatus 20. The clip 50 may be spring loaded or include a bias member to apply the clamping force. The clip handles 52 may be pressed together to open the opposing clamping ends 54 to receive the garment 3 and correspondingly to release the garment 3 from its hold upon removal. The clips 50 may secure to the garment 3 adjacent the garment waist or waist line 4. The first and second clips 50 may be spaced from each other when attached to the garment 3. One or the first clip 50 and the other or second clip 50 may be spaced along the medial lateral direction or opposing sides of the user's waist as shown in FIG. 2. In some embodiments, the clamping ends 54 of each clip 50 may include a material or pads 55 to protect the garment 3 from damage during the progressive pulling or sliding off of the garment 3 from the upper body when the user moves or backs away from portions of the apparatus 20 or attachment mechanism 30. The clip 50 may be a variety of quantities, shapes, sizes, constructions, and orientations and still be within the scope of the teachings herein.

Figure 4:
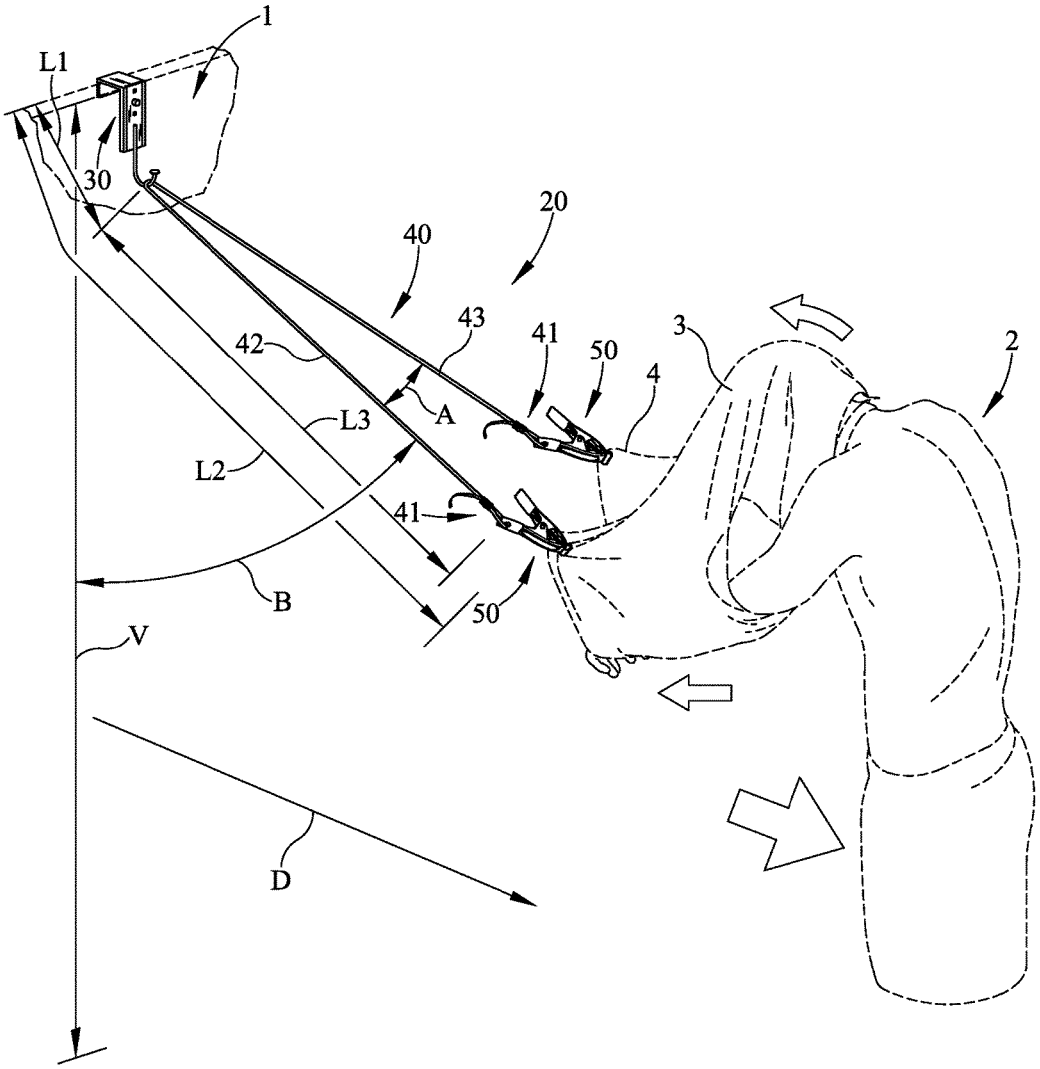
FIG. 4 is another perspective view of the apparatus of FIG. 3 continuing to illustrate the progressively pulled garment passing over the shoulders before sliding subsequently over the neck, head, arms, and/or hands upon increasing the distance from the apparatus, the attachment mechanism, and/or object.

When progressively pulling the garment from the upper body, the one or more cables 40 and/or one or more clips 50 may change positions and orientations relative to each other. Moreover, the cables 40 and/or clips 50 may also change relative angles and/or heights relative to the horizontal plane or floor, vertical plane or axis V, and/or attachment mechanism 30 during the progressive pulling of the garment. In some embodiments, the attachment mechanism 30 and/or object 1 is adjacent to the vertical plane V. When the user 2 pulls or backs away in a direction away from the object 1 or portions of the apparatus 20, the garment 3 pulls from the waist towards the shoulders. In some embodiments, the garment 3 may be pulled over one or more portions of the waist, chest, shoulders, arms, neck, head, limbs, and/or hands for removal from the upper body. During the progressive movement of the garment 3 during removal, the cables 40 and clips 50 may move relative to each other to assist in the garments removal. One or more cables 40 and/or one or more clips 50 may pivot and/or change angles A and/or elevation/height H (e.g. increase or decrease) relative to each other to contour to the shape and/or position of the user 2 or portions of the user's body as the garment travels upon the user's body. For example the angle A may be less when the garment is adjacent the head and arms (FIG. 4) than when the angle A is adjacent the waist (FIG. 2). Moreover, the cables 40 may pivot at an angle B relative to the vertical plane V of the position of the attachment mechanism 30 and/or object 1. For example, when the user moves away or increases the distance D transverse from the object 1/vertical plane V, attachment mechanism 30, clips 50, and/or one or more cables 40 may pivot upwardly and away from the horizontal and/or floor. As a result, in some embodiments, the angle B of one or more cables/clips may progressively increase from the vertical plane (e.g. angle B of FIG. 2 is less than angle B of FIG. 4). Moreover, in some embodiments, the height H of one or more clips and/or portions of the cable may increase as the transverse distance D from the object and/or apparatus increases.

In various embodiments, the apparatus 20 may be part of medical kit. One embodiment of the kit may be provided to the user for post-surgery use. For example, upon receiving shoulder surgery, the kit with apparatus may include items such as, but is not limited to, shoulder/arm sling, arm sling accessories (e.g. one or more pads), exercise straps, bandages, cool/heat pads, exercise instructions, etc.

Figure 3:
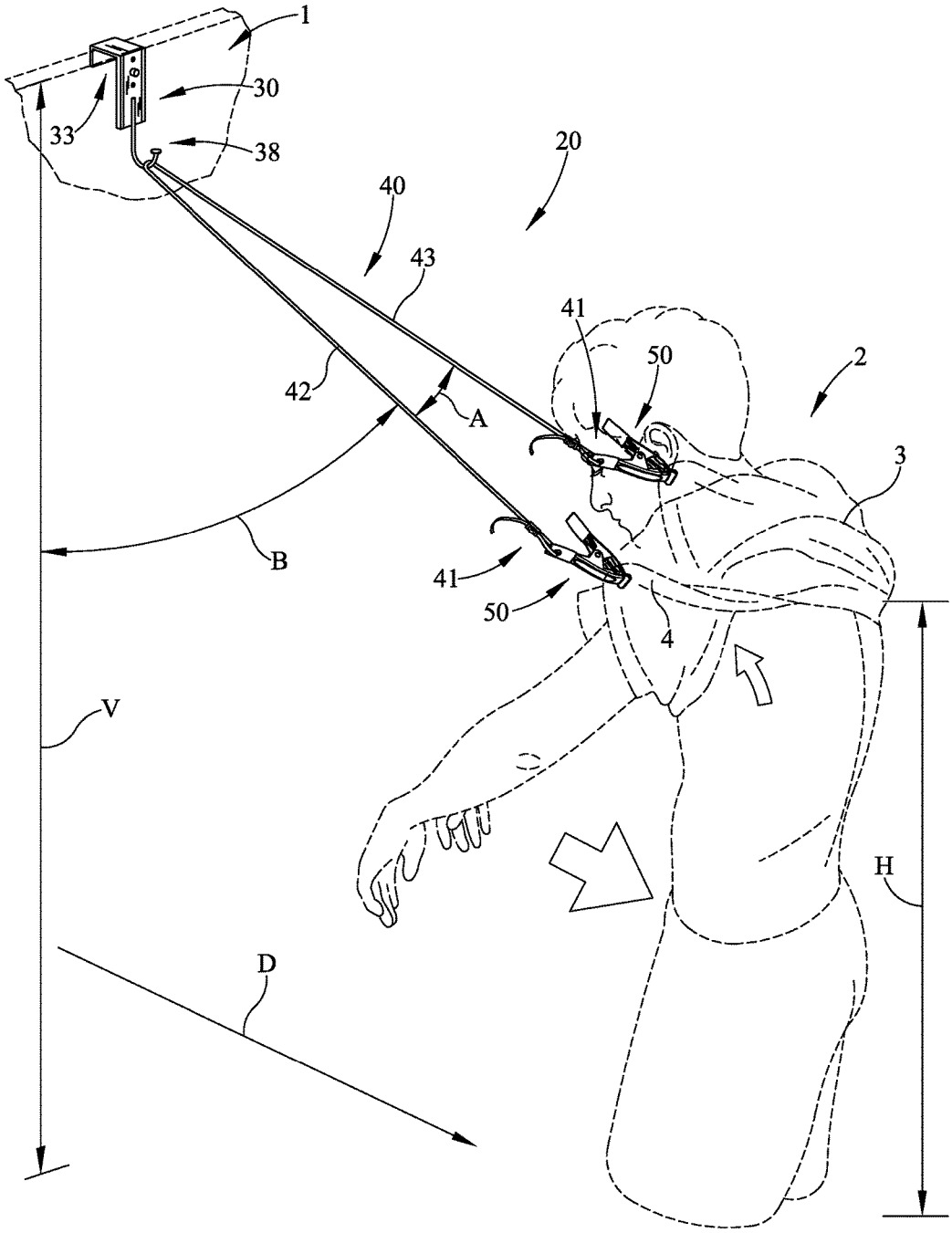
FIG. 3 is a perspective view of the apparatus of FIG. 2 illustrating the user moving away from the direction the user is facing, attachment mechanism, and/or object progressively pulling the garment away from the user's body.

In use, the method of removing the garment 3 from the upper body of a user 2 may include a variety of steps. In some embodiments, the apparatus 20 may be provided with the one or more attachment mechanisms 30, one or more cables 40, and clips 50 attached thereto. The attachment mechanism 30 may be attached to the object 1 in a variety of ways. In the embodiment shown, the attachment mechanism 30 is place over a top of the object 1 (e.g. door). Moreover, the attachment mechanism 30 may be adjusted by the user to a higher/lower elevation by relocating or decreasing the overall length (e.g. changing the configuration or cable attachment location) of the attachment mechanism. The attachment mechanism may not be adjustable in length in some embodiments. In some embodiments, the user may select the apertures 31*a*, 32*a* of the first and second portion 31, 32, respectively, to adjust the elevation of the attachment mechanism 30, cable 40, and/or clip 50. The elevation and/or length of the attachment mechanism may be selected or predetermined. The elevation in some embodiments may be above the torso (e.g. waist, shoulders, head, chest, etc.). In some embodiments, the higher the attachment mechanism 30 is secured, the garment 3 may be easier to remove or may reduce leaning of the user 2 when facing towards the object. If the one or more cables 40 and/or clips 50 are not already attached to the attachment mechanism 30 when secured to the object, the cables 40 and clips 50 may be subsequently attached to the attachment mechanism 30 by the user. In various embodiments, the clips 50 may be attached to the garment 3 (e.g. adjacent the waist or waist line 4) with the user 2 facing towards the object 1 and/or apparatus 20. The clips 50 may be spaced apart from each other on the garment 3. The clips 50 may be adjacent and on opposite hips of the user. The user 2 may adjust the length L3 of one or more of the cables 40 from the attachment mechanism 30 to the respective clip 50. The length L3 of the cables may not be adjusted in some embodiments. The user 2 moves away from or increases the distance from the object 1 and/or portions of the apparatus 20. With the user 2 facing towards the apparatus 20 or object 1, the user 2 may back away or reverse from the apparatus 20. The user 2 may move rearward for the distance D transverse to the vertical plane V of the attachment mechanism 30 in some embodiments. More specifically in some embodiments, the user 2 may move horizontally away from the object 1 and/or or portions of the apparatus 20 for the distance D. With the apparatus fixed to the object (e.g. with the substantially fixed overall length L2), the garment 3 may be progressively pulled off the user 2 in the direction from waist towards the shoulders. This may include sliding the garment 3 over the shoulders, arms, neck, and/or head etc. The garment 3 may progressively slide away from in sequence from the waist, chest, shoulders, arms head, and/or hands. When the user 2 increases the distance D from the vertical plane V, object 1, and/or apparatus 20, the user may raise and extend both arms, upwards and away towards the apparatus 20, object 1, and/or vertical plane V, or to such an orientation that is comfortable relative to the user's ability due to the surgery or condition. The arms may be raised up (i.e. overhead) in various embodiments. In some embodiments, by progressively pulling the garment 3 along the contours of the user's body (FIGS. 2-4) the user may be assisted in manipulating and/or guiding the position of the arms to allow the garment to be pulled off the upper body more easily (e.g. the shoulders, head, and/or arms). When increasing the distance D from the object by moving backwards in some embodiments, the angle B of the cables 40 from the substantially vertical plane V (e.g. object's position or attachment mechanism) and/or height H of the clips 50 may progressively increase. In some embodiments, when increasing the distance D from the object 1, the angle A and/or height H between the two cables/clips may change. After the garment 3 is progressively pulled and removed, or substantially pulled off the user (e.g. the arms and/or hands), the one or more clips 50 may be removed or released from the garment 3 until the apparatus's next use.

Moreover in use, the user may have limited limb mobility due to surgery or a medical condition and still desire to have an upper garment removed by pulling over the head and/or arms. When removing the garment 3, the user may reach down to attach clips to the waist area 4 of the garment. Therefore the user may not have to raise the limb to a potentially painful position or to an upward position that may not be physically available. By facing and stepping/moving away (e.g. backwards) from the attached apparatus 20, the user may not have to reach and pull up the garment over the arms and/or head since the fixed apparatus pulls in the opposite direction of the body's movement. In some embodiments, leaning forward towards and raising/extending the limbs towards the apparatus, cables, and/or attachment mechanism may ease the removal of the garment. The pressure or forces from the garment and/or apparatus, when progressively sliding along the upper body, may raise and extend the arms and therefor may assist the user in garment removal. Therefore in some embodiments, the user may not have to raise the arms or may not have the ability to raise the arms such that the use of the apparatus may raise the arms for the user.

With the user facing in the direction of the apparatus, or portions thereof, and/or towards the object's placement, the user may move backwards or away from the attachment mechanism in a variety of ways. The user may progressively step backwards until removal or a portion of the removal occurs. In some embodiments, the user may step backwards and/or move to a sitting position to allow the garment to be pulled away or partially away from the upper body. In various embodiments, the user could alternatively be stationary (e.g. standing or sitting) and the cables and/or clips may be pulled away from the facing user to remove the garment. In some embodiments, a motor mechanism may power the movement and/or retracting of the cable/clip towards the attachment mechanism.

The apparatus 20 may include an overall length L2 that can be adjusted to setup the desired length between the object/attachment mechanism and the garment attachment location that the clips secure to. By adjusting the overall length L2, the apparatus may be operable with a variety of heights of users and/or other characteristics. In some embodiments, one or more portions of the apparatus 20 may be adjustable to achieve a variety of overall lengths. It is understood, in some embodiments, the overall length L2 may not be adjustable. In various embodiments, placement of the attachment mechanism at a desired elevation may allow adjustment of a fixed overall length L2. In some embodiments, for example, may include a length L3 of one or more cables that may be cut to length for a particular user/object configuration.

In various embodiments, the overall length L2 of the apparatus 20 may be changed, if not fixed in length. The length L3 of the cables 40 may be reduced in some embodiments, if not fixed in length. In some embodiments, this may occur when the user is adjacent to and facing the object 1 or attachment mechanism 30. If adjustable, the buckles 44 may be used to reduce the cables 40 length L3. If adjustable, the attachment mechanism 30 may be used to reduce/increase the length L1. By adjusting the overall length L3, the user 2 may setup an apparatus 20 to be appropriately configured to the user's shape, height, size (e.g. waist height), health condition, and/or the height or placement of the attachment mechanism 30/apparatus 20.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A method of removing a garment from an upper body of a user comprising the steps of:

providing an attachment mechanism;

attaching said attachment mechanism to an object;

providing at least one elongated cable having opposing free ends, wherein said at least one cable is coupled between said opposing free ends to said attachment mechanism;

providing a clip at each said opposing free end of said at least one cable;

attaching each clip adjacent to a garment waist, wherein said clips are spaced apart from each other;

increasing a distance of said user from the object; and progressively pulling the garment from said user in a direction from a waist of said user towards one or both shoulders of said user.

2. The method of claim 1 wherein said attachment mechanism is at an elevation above at least one of said waist of said user, a chest of said user, and said one or both shoulders of said user.

3. The method of claim 2 wherein said attachment mechanism is at said elevation above said one or both shoulders of said user.

4. The method of claim 1 further comprising the step of adjusting an elevation of said attachment mechanism relative to said user.

5. The method of claim 1 wherein the step of increasing said distance of said user from the object includes said user facing towards the object.

6. The method of claim 1 wherein the step of increasing said distance of said user from the object includes raising and extending both arms of said user.

7. The method of claim 1 further comprising the step of removing said clips from the garment after the step of progressively pulling the garment from the said user in said direction from said waist of said user towards said one or both shoulders of said user.

8. The method of claim 1 wherein the step of increasing said distance of said user from the object includes progressively increasing an angle of said at least one cable from a vertical plane.

9. The method of claim 1 wherein the step of progressively pulling the garment from said user in said direction from said waist of said user towards said one or both shoulders of said user includes sliding the garment over a chest of said user, said one or both shoulders of said user, and one or both arms of said user.

10. The method of claim 1 wherein the step of increasing said distance of said user from the object includes said user horizontally moving away from the object.

11. The method of claim 1 further comprising the step of adjusting a length of said at least one cable from said attachment mechanism to at least one said clip.

12. A method of removing a garment from an upper body of a user comprising the steps of:

providing a first clip and a second clip attached to opposing free ends of at least one cable, wherein an attachment mechanism in a vertical plane is secured between said opposing free ends of said at least one cable;

attaching said first clip and said second clip to the garment adjacent a waist of said user;

moving said upper body of the said user away from said attachment mechanism;

progressively sliding the garment in sequence from said waist of said user towards one or both shoulders of said user.

13. The method of claim 12 wherein the step of moving said upper body of said user away from said attachment mechanism includes moving a distance transverse to said vertical plane of said attachment mechanism.

14. The method of claim 13 wherein the step of moving said upper body of said user away from said attachment mechanism includes said user facing towards said attachment mechanism.

15. The method of claim 13 wherein the step of moving said distance transverse to said vertical plane of said attachment mechanism includes progressively increasing an angle of said at least one cable from said vertical plane.

16. The method of claim 12 further comprising the step of adjusting a length of said at least one cable from said attachment mechanism to at least one of said first clip and said second clip.

17. The method of claim 12 further comprising the step of adjusting an elevation of said attachment mechanism relative to said user.

18. The method of claim 12 further comprising the step of removing said first clip and said second clip from the garment after the step of progressively sliding the garment in sequence from said waist of said user towards said one or both shoulders of said user.

* * * * *